US006374428B1

(12) United States Patent
Copeland et al.

(10) Patent No.: US 6,374,428 B1
(45) Date of Patent: Apr. 23, 2002

(54) SPLASH REDUCING PANELS

(76) Inventors: Erma R. Copeland; April M. Cole; Maurice D. Cole, all of 6020 Creekside Dr., Columbus, GA (US) 31907

( * ) Notice: Subject to any disclaimer, the term of this patent is extended or adjusted under 35 U.S.C. 154(b) by 0 days.

(21) Appl. No.: 09/616,918

(22) Filed: Jul. 14, 2000

(51) Int. Cl.[7] ..... E03D 9/00
(52) U.S. Cl. ..... 4/300.3; 4/DIG. 5; 4/DIG. 18
(58) Field of Search ..... 4/300.3, DIG. 5, 4/DIG. 18, 245.6, 245.8, 315

(56) References Cited

U.S. PATENT DOCUMENTS

| | | | | | |
|---|---|---|---|---|---|
| 3,263,241 | A | * | 8/1966 | Saulson | |
| 3,383,710 | A | * | 5/1968 | Sumner | 4/300.3 |
| 3,762,875 | A | * | 10/1973 | Burmeister | |
| 3,763,502 | A | * | 10/1973 | Laumann | 4/112 |
| 4,010,497 | A | | 3/1977 | Menter et al. | |
| 4,465,733 | A | * | 8/1984 | Sumner | 4/300.3 |
| 4,705,050 | A | | 11/1987 | Markham | |
| 4,743,395 | A | * | 5/1988 | Leifheit | 252/106 |
| 4,887,321 | A | * | 12/1989 | MacLean | 4/243 |
| 5,031,253 | A | * | 7/1991 | Brendlinger | 4/300.3 |
| 5,117,515 | A | * | 6/1992 | White, Jr. et al. | 4/300.3 |
| 5,152,996 | A | | 10/1992 | Corey et al. | |
| D341,414 | S | | 11/1993 | Baker | |
| 5,644,801 | A | | 7/1997 | Zhao et al. | |
| 5,707,736 | A | | 1/1998 | Levy et al. | |

FOREIGN PATENT DOCUMENTS

| | | | | |
|---|---|---|---|---|
| DE | 2952773 A1 | * | 7/1981 | 4/DIG. 18 |
| NL | 7902249 | * | 9/1980 | 4/DIG. 18 |

* cited by examiner

*Primary Examiner*—Timothy L. Maust
*Assistant Examiner*—Khoa D. Huynh

(57) ABSTRACT

A splash reducing panels for providing a toilet splash reducing product in a compact easy to carry size. The splash reducing panels includes a panel formed from a fibrous material and containing a germicide comprising n-Alkyl, dimethyl, benzyl ammonium chloride, dimethyl benzyl ethylbenzyl, ammonium chloride and inert ingredients. The panel is preferably adapted to expand from a relatively smaller first size to a relatively larger second size when the panel is brought into contact with water. The panel may be in a folded form and be adapted to unfold when brought into contact with water, and the panel may have a plurality of ridges formed therein that become relatively flat when moistened.

3 Claims, 3 Drawing Sheets

FIG. 6
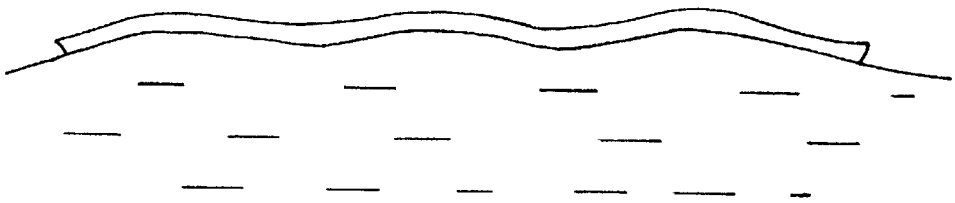
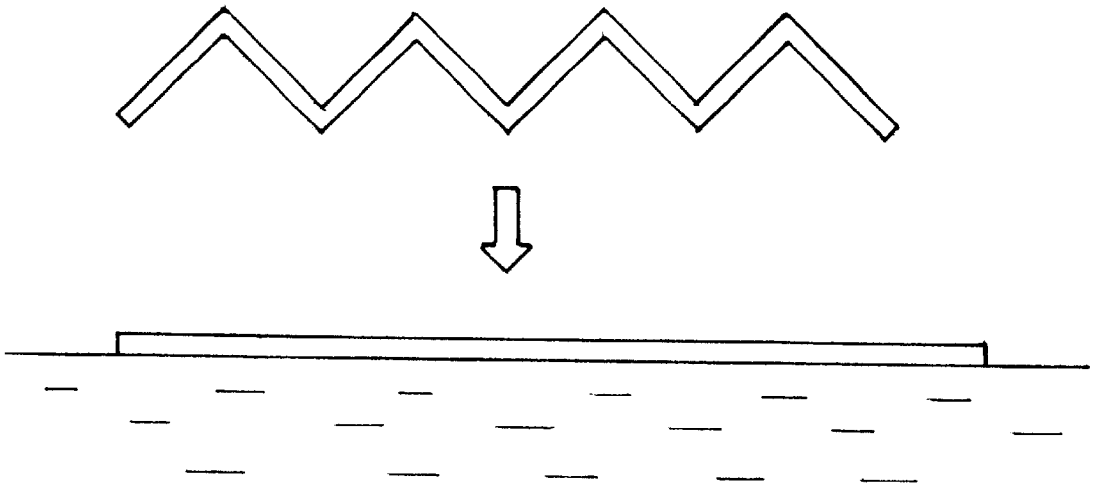
FIG. 7

SPLASH REDUCING PANELS

BACKGROUND OF THE INVENTION

1. Field of the Invention

The present invention relates to splash preventing products and more particularly pertains to a new splash reducing panels for providing a toilet splash reducing product in a compact easy to carry size.

2. Description of the Prior Art

The use of splash preventing products is known in the prior art. More specifically, splash preventing products heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,010,497; 5,152,996; 4,705,050; 5,707,736; 5,644,801; and U.S. Pat. No. Des. 341,414.

While these devices fulfill their respective, particular objectives and requirements, the aforementioned patents do not disclose a new splash reducing panels. The inventive device includes a panel formed from a fibrous material and containing a germicide comprising n-Alkyl, dimethyl, benzyl ammonium chloride, dimethyl benzyl ethylbenzyl, ammonium chloride and inert ingredients.

In these respects, the splash reducing panels according to the present invention substantially departs from the conventional concepts and designs of the prior art, and in so doing provides an apparatus primarily developed for the purpose of providing a toilet splash reducing product in a compact easy to carry size.

SUMMARY OF THE INVENTION

In view of the foregoing disadvantages inherent in the known types of splash preventing products now present in the prior art, the present invention provides a new splash reducing panels construction wherein the same can be utilized for providing a toilet splash reducing product in a compact easy to carry size.

The general purpose of the present invention, which will be described subsequently in greater detail, is to provide a new splash reducing panels apparatus and method which has many of the advantages of the splash preventing products mentioned heretofore and many novel features that result in a new splash reducing panels which is not anticipated, rendered obvious, suggested, or even implied by any of the prior art splash preventing products, either alone or in any combination thereof.

To attain this, the present invention generally comprises a panel formed from a fibrous material and containing a germicide comprising n-Alkyl, dimethyl, benzyl ammonium chloride, dimethyl benzyl ethylbenzyl, ammonium chloride and inert ingredients. The panel is preferably adapted to expand from a relatively smaller first size to a relatively larger second size when the panel is brought into contact with water. The panel may be in a folded form and be adapted to unfold when brought into contact with water, and the panel may have a plurality of ridges formed therein that become relatively flat when moistened.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new splash reducing panels apparatus and method which has many of the advantages of the splash preventing products mentioned heretofore and many novel features that result in a new splash reducing panels which is not anticipated, rendered obvious, suggested, or even implied by any of the prior art splash preventing products, either alone or in any combination thereof.

It is another object of the present invention to provide a new splash reducing panels which may be easily and efficiently manufactured and marketed.

It is a further object of the present invention to provide a new splash reducing panels which is of a durable and reliable construction.

An even further object of the present invention is to provide a new splash reducing panels which is susceptible of a low cost of manufacture with regard to both materials and labor, and which accordingly is then susceptible of low prices of sale to the consuming public, thereby making such splash reducing panels economically available to the buying public.

Still yet another object of the present invention is to provide a new splash reducing panels which provides in the apparatuses and methods of the prior art some of the advantages thereof, while simultaneously overcoming some of the disadvantages normally associated therewith.

Still another object of the present invention is to provide a new splash reducing panels for providing a toilet splash reducing product in a compact easy to carry size.

Yet another object of the present invention is to provide a new splash reducing panels which includes a panel formed from a fibrous material and containing a germicide comprising n-Alkyl, dimethyl, benzyl ammonium chloride, dimethyl benzyl ethylbenzyl, ammonium chloride and inert ingredients.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a schematic edge view of the panel of FIG. 5 shown with the ridges substantially flattened.

FIG. 7 is a schematic edge view of the panel having a first contracted size and a second expended size.

DESCRIPTION OF THE PREFERRED EMBODIMENT

Figure 1:
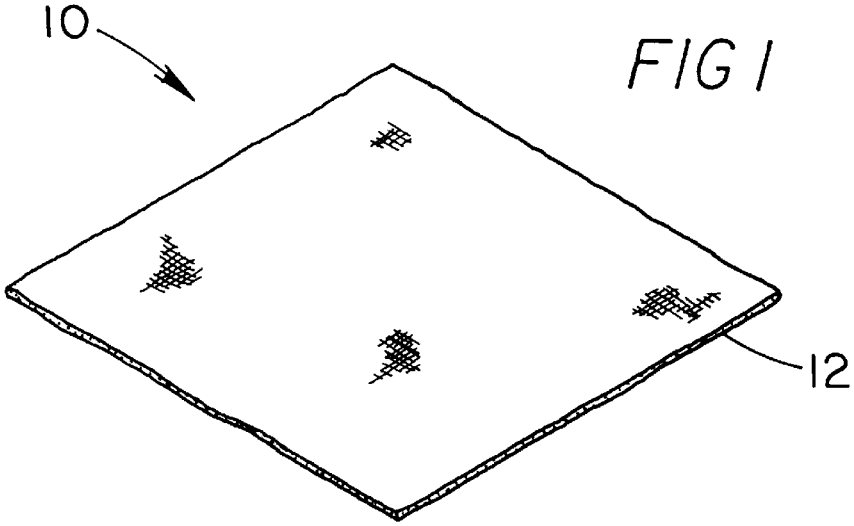
FIG. 1 is a perspective view of a new splash reducing panels according to the present invention.
Figure 2:
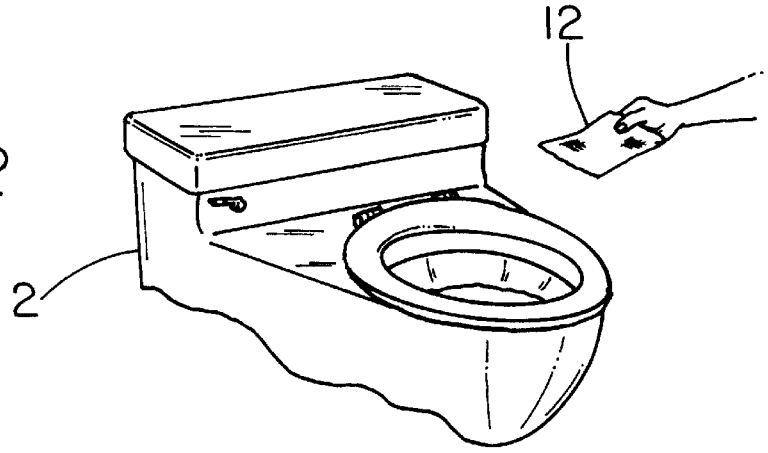
FIG. 2 shows one preferred use of the present invention.
Figure 3:
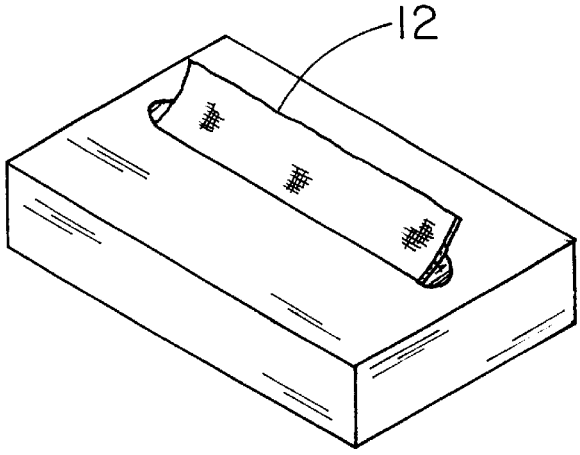
FIG. 3 shows one manner of dispensing the present invention.
Figure 4:
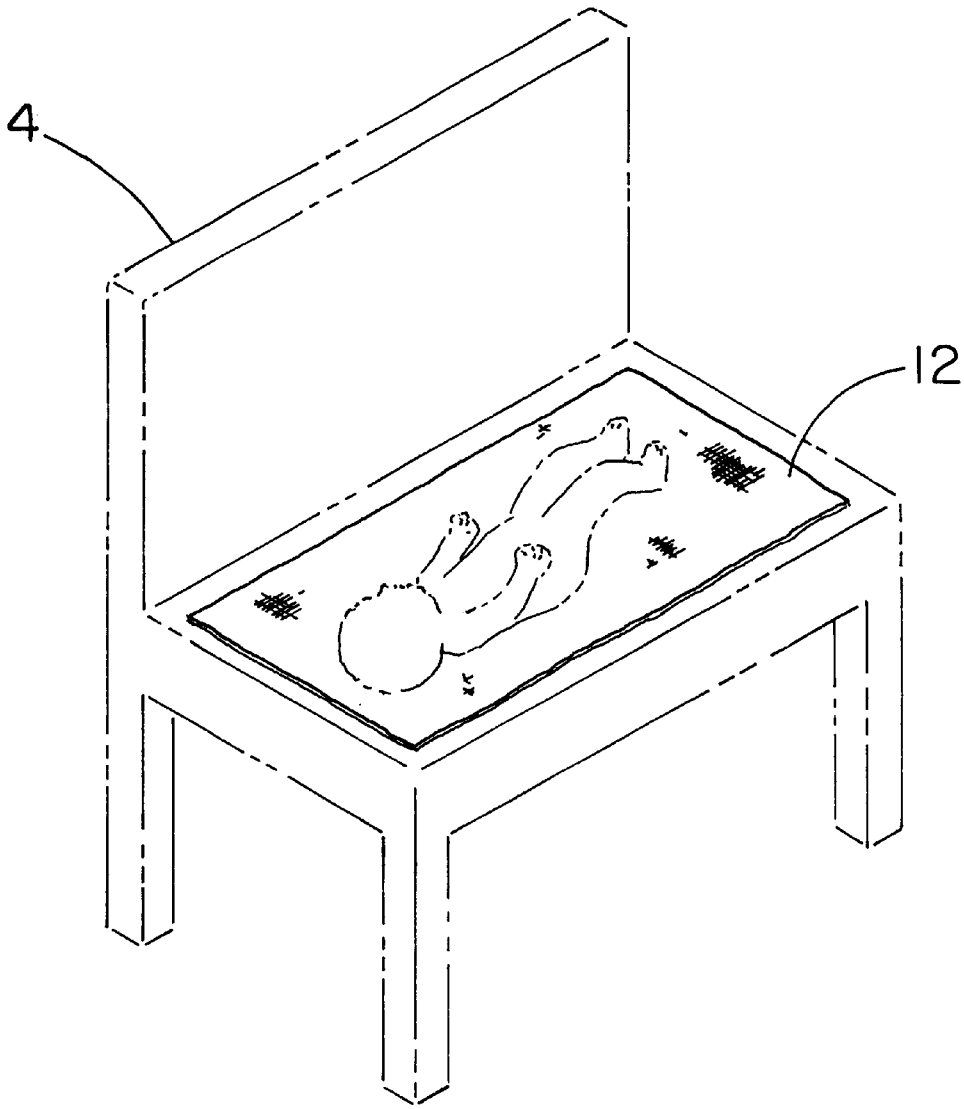
FIG. 4 shows an optional use of the present invention.
Figure 5:
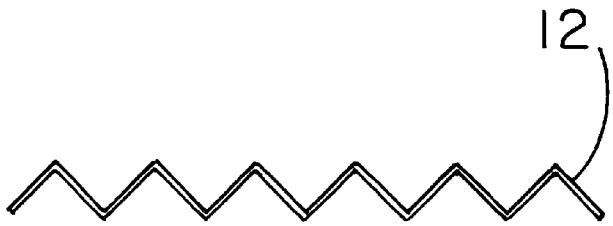
FIG. 5 shows one preferred side view of the present invention

With reference now to the drawings, and in particular to FIGS. 1 through 5 thereof, a new splash reducing panels embodying the principles and concepts of the present invention and generally designated by the reference numeral 10 will be described.

As best illustrated in FIGS. 1 through 5, the splash reducing panels 10 generally comprises a panel of fibrous material 12 containing a germicide.

A panel 12 is formed from a fibrous material which is designed to resist disintegration when brought into contact with water, but to be broken up by the mechanical action encountered in a sanitary sewer system for facilitating safe flushing of the fibrous panel. A fibrous construction somewhat heavier than conventional toilet tissue but lighter than conventional kitchen use paper towels is considered most suitable.

In one embodiment, the fibrous material has a germicidal composition applied to it that is water soluble, such that placement of the panel 12 into water causes the germicidal composition to be released from the fibrous material into the water. A preferred germicide comprises n-Alkyl, dimethyl, benzyl ammonium chloride, and dimethyl benzyl ethylbenzyl.

In another embodiment, the fibrous material optionally has a bactericidal composition applied thereto that is water soluble such that placement of the panel 12 in water causes the bactericidal composition to be release from the fibrous material.

In an illustrative embodiment, the panel 12 has dimensions of approximately 8 inches in length by 8 inches in width with a thickness of approximately one-sixteenth of an inch. A panel of these particular dimensions is submitted to be highly suitable for covering the water surface of the bowls of most toilets.

Preferably the panel 12 is provided in a folded form (optionally in a disposable package) and is designed to unfold from the folded form when brought into contact with water. This may be accomplished, for example, by folding the panel 12 in an accordion or pleated fashion for compact storage. Exposure of the pleated panel 12 to water in a toilet bowl 2 causes the panel 12 to lose the accordion shape and become substantially flat. Illustratively, the panel 12 may have an amount of a water soluble substance applied thereto that holds the panel 12 in a folded condition, but relaxes upon exposure to water. Common fabric softener sheets are one illustrative example.

In a further embodiment the panel 12 is designed to expand from a relatively smaller first size to a relatively larger second size when the panel 12 is brought into contact with water. The panel has a plurality of ridges formed therein that become relatively flat when moistened.

The panel 12 is useful in practicing a method of reducing splashing water in a toilet bowl 2. A panel 12 is provided that is formed from a fibrous material being designed to resist disintegration when brought into contact with water but being adapted to being broken up by the mechanical action encountered in a sanitary sewer system for facilitating safe flushing of the panel 12.

The panel 12 is placed in the water in the bowl of a toilet 2. The panel 12 expands to cover substantially an entire upper surface of the water in the toilet bowl 2 to reduce splashing from the upper surface of the water.

Additionally a germicidal composition may be released into the water of a toilet bowl 2 from a germicidal composition applied to the panel 12.

The panel 12 may be flushed down the toilet 2 after use.

In use, the splash reducing panels 12 will be either place directly into a toilet 2 or placed on a baby station 4 or other flat surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of reducing splashing of water in a toilet bowl, comprising the acts of:

providing a panel formed from a fibrous material, the fibrous material being adapted to retain its form when brought into contact with water but being adapted to be broken up by the mechanical action encountered in a sanitary sewer system for facilitating safe flushing of the panel, the panel being in a folded form and being adapted to unfold when brought into contact with water;

placing the panel in the water in the bowl of a toilet such that the panel is brought into contact with the water; and expanding the panel to cover substantially an entire upper surface of the water in the toilet bowl to reduce splashing from the upper surface of the water.

2. The method of claim 1 additionally comprising the act of releasing a germicidal composition into the water of a toilet bowl from a germicidal composition applied to the panel.

3. The method of claim 1 additionally comprising the act of flushing the panel down the toilet.

* * * * *